US005153482A

United States Patent [19]

Keijser et al.

[11] Patent Number: 5,153,482

[45] Date of Patent: Oct. 6, 1992

[54] HIGH-PRESSURE SODIUM DISCHARGE LAMP

[75] Inventors: Robertus A. J. Keijser; Monique M. F. Eerdekens, both of Eindhoven, Netherlands

[73] Assignee: U.S. Philips Corporation, New York, N.Y.

[21] Appl. No.: 657,003

[22] Filed: Feb. 13, 1991

[30] Foreign Application Priority Data

Feb. 21, 1990 [NL] Netherlands ..... 9000410

[51] Int. Cl.[5] ..... H01J 61/38; H01J 61/073

[52] U.S. Cl. ..... 313/634; 313/25; 313/17; 313/620; 313/643

[58] Field of Search ..... 313/634, 25, 631, 620, 313/44, 17, 643

[56] References Cited

U.S. PATENT DOCUMENTS 4,134,039 1/1979 Vida et al. ..... 313/640
4,490,642 12/1984 Dobrusskin et al. ..... 313/25
4,795,943 1/1989 Antonis ..... 313/631 X
4,864,191 9/1989 Van De Weijer et al. .... 313/631 X
4,970,431 11/1990 Vegter et al. ..... 313/634

FOREIGN PATENT DOCUMENTS 2083281 3/1982 United Kingdom .

*Primary Examiner*—Donald J. Yusko
*Assistant Examiner*—Ashok Patel
*Attorney, Agent, or Firm*—Brian J. Wieghaus

[57] ABSTRACT

The invention relates to a high-pressure sodium discharge lamp provided with a discharge vessel having a ceramic wall and enclosed with intervening space by an outer bulb. The discharge vessel is provided with two electrodes whose respective tips have a mutual distance D. The discharge vessel has a substantially circular cross-section with an interior diameter $d_i$ over the distance D. Under nominal operating conditions, according to the invention, the wall has a wall load of at least 60 W/cm$^2$, the space between the outer bulb and the discharge vessel contains a gas filling, and $D/d_i$ being $>6$.

10 Claims, 1 Drawing Sheet

HIGH-PRESSURE SODIUM DISCHARGE LAMP

BACKGROUND OF THE INVENTION

The invention relates to a high-pressure sodium discharge lamp comprising a discharge vessel enclosed with intervening space by an outer bulb and having a ceramic wall, in which two electrodes are present with respective tips spaced apart by a distance D and in which at least over the distance D the discharge vessel has a substantially circular cross-section with an internal diameter $d_i$, the lamp radiating light with a colour temperature $T_c$ of at least 2400K under nominal operating conditions.

A lamp of the type described in the opening paragraph is known from GB-A-2,083,281. The known lamp radiates white light with a good colour rendering expressed as the colour rendering index $R_a$ with a value of more than 80. Generally, the region in the colour triangle bounded by straight lines through points having coordinates (x; y); (0.400; 0.430), (0.510; 0.430), (0.485; 0.390) and (0.400; 0.360) can be regarded as representing "white" light in the case of light radiated by high-pressure sodium lamps. The colour temperature $T_c$ lies between approximately 2300K and 4000K in this case.

The known lamp can be used to replace an incandescent lamp, for example in accent lighting applications. The colour temperature $T_c$ of the known lamp, however, is relatively low for this in comparison with the light radiated by incandescent lamps. A colour rendering index $R_a$ above 80 is necessary for incandescent lamp replacement. The maximum achievable colour rendering index value for practical high-pressure sodium lamps is between 80 and approximately 85.

SUMMARY OF THE INVENTION

The invention has for its purpose inter alia to provide a lamp with which light can be radiated having a colour temperature $T_c$ considerably higher than 2400K, the colour rendering index $R_a$ being $>80$.

According to the invention, this object is achieved in that the lamp of the type described in the opening paragraph in that the ceramic wall of the discharge vessel has a wall load of at least 60 W/cm$^2$ under nominal operating conditions, the space between the outer bulb and the discharge vessel contains a gas filling, and the ratio $D/d_i$ is $>6$.

With the lamp according to the invention it is possible to generate light with a considerably higher colour temperature than 2400K, while a colour rendering index value $R_a$ of above 80 is retained. It is found that the luminous efficacy is thereby at least maintained with respect to the cited prior art lamp having a lower color temperature. The following can be remarked in this connection.

A high-pressure sodium discharge lamp radiates light with a spectrum which is characterized by an absorption band near 589 nm, with spectral flanks having maxima at a mutual distance $\Delta\lambda$ on either side. The mutual distance $\Delta\lambda$ is between approximately 40 and approximately 55 nm in the case of a colour rendering index $R_a$ above 80 of the radiated light. It is known that a further widening of the absorption band, so a further increase of the mutual distance $\Delta\lambda$, is capable of increasing the colour temperature $T_c$ of the radiated light further to above 2500K. This, however, is to the detriment of the colour rendering and the luminous efficacy. In addition, widening of the absorption band while the interior diameter of the discharge vessel remains the same implies a rise of the sodium pressure in the discharge vessel. A rise in the sodium pressure is unfavourable for lamp life because it is especially the sodium pressure which influences the speed of the various corrosion processes in and of the discharge vessel.

It should be noted that the term "wall load" in the present description and accompanying claims is defined as the ratio of the nominal lamp power in W to the interior surface area of the discharge vessel wall over the distance D.

In the lamp according to the invention, the nominal lamp voltage corresponds substantially to the lamp voltage of a known lamp of corresponding nominal power. This is particularly favourable for use of the lamp according to the invention in an existing installation. An increase of the wall load through reduction of the distance D leads to a reduction of the lamp voltage. A reduction of the internal diameter $d_i$, on the other hand, leads to an increase in lamp voltage.

A ceramic wall in the present description and accompanying claims is understood to mean a wall made of crystalline metal oxide or crystalline metal nitride which is highly resistant to the attack by sodium at high temperatures, such as, for example, monocrystalline sapphire polycrystalline gas-tight sintered $Al_2O_3$, or polycrystalline gas-tight sintered AlN. The known wall materials are capable of withstanding temperatures up to approximately 1400K during long periods at the sodium pressure prevalent in the lamp. At substantially higher temperatures, the prevalent sodium pressure leads to a considerable degree of corrosion of the ceramic wall. The use of a gas filling in the space between the discharge vessel and the outer bulb achieves an increased heat transport, so that the temperature of the discharge vessel wall remains within acceptable limits, also in the case of higher wall loads. Suitable gases are, for example, rare gases and nitrogen, since these gases are inert to a high degree under the prevailing circumstances. The gas filling may be composed of a single gas, but a mixture of gases is also possible. Where safety is of exceptional importance, the filling pressure of the gas filling is so chosen that the pressure of the gas filling is approximately 1 at under nominal operational conditions of the lamp.

A further improvement regarding the control of the maximum wall temperature of the discharge vessel can be achieved through the choice of the wall thickness. An increase in wall thickness leads to an increased heat radiation of the wall and promotes further heat transport from the area between the electrode tips to the relatively cool ends of the discharge vessel.

On the other hand, an increase in wall thickness adversely affects the luminous flux. In addition, manufacture becomes more difficult with increasing wall thicknesses owing to the increasing risk of irregular crystal growth and the increasing risk of internal fractures. This is why the wall thickness is preferably chosen to be smaller than 3 mm.

A choice in favour of a comparatively great $D/d_i$ ratio leads to a comparatively long discharge vessel. It is known, however, that the maximum wall temperature of the discharge vessel is higher in proportion as the discharge vessel is longer, the wall load remaining the same. For present practice, therefore, it is preferable to choose the $D/d_i$ ratio to be not greater than 10. An additional advantage of the discharge vessel dimensions being restricted in this way is that a desired light distribution can be realized in a simpler and often better way by means of a light-distributing optical system.

BRIEF DESCRIPTION OF THE DRAWINGS

An embodiment of a lamp according to the invention will be explained in more detail with reference to a drawing. In the drawing

DESCRIPTION OF THE PREFERRED EMBODIMENTS

Figure 1:
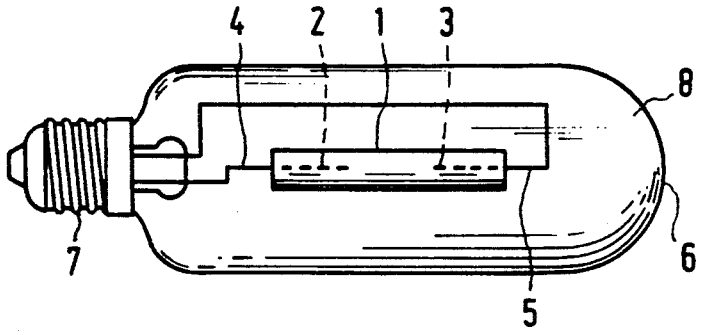
FIG. 1 shows a lamp provided with an outer bulb in side elevation.

In FIG. 1, reference numeral 1 denotes a discharge vessel having a ceramic wall which is enclosed with intervening space 8 by an outer bulb 6. The space 8 contains a gas filling. Inside the discharge vessel 1 there are two pin electrodes 2 and 3 with respective tips having a mutual distance D, the discharge vessel 1 having a substantially circular cross-section between the electrodes 2 and 3. The electrodes 2 and 3 are connected to current conductors 4 and 5, respectively. The outer bulb is provided with a lamp cap 7, to which the current conductors 4, 5 are connected. The discharge vessel, which contains a filling of sodium, mercury, and rare gas, has an internal diameter $d_i$ over the distance D.

Figure 2:
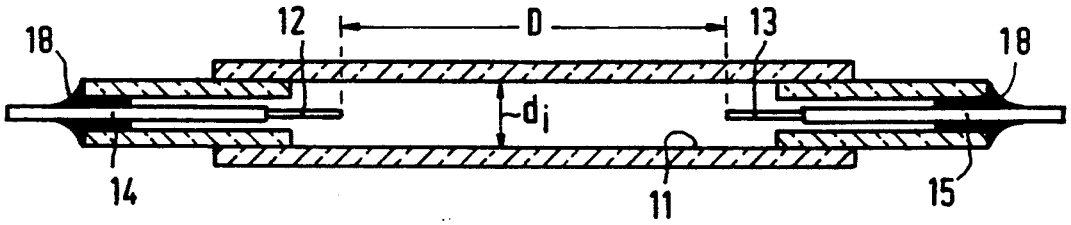
FIG. 2 shows a lamp in longitudinal section.
Figure 3:
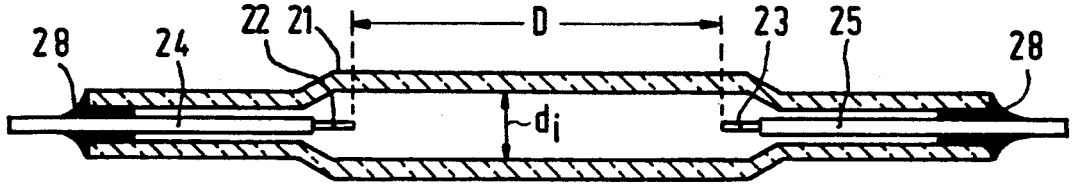
FIG. 3 shows another lamp in longitudinal section.

In FIGS. 2 and 3, corresponding parts have reference numerals which are ten and twenty higher than those in FIG. 1, respectively . The electrodes 12, 13 and 22, 23, respectively, consist of tungsten/rhenium (97/3 weight ratio), while the current conductors 14, 15, 24, 25 consist of Nb. The discharge vessels 11, 21 are sealed off with melting ceramic 18, 28, respectively.

Lamps according to the invention were manufactured with discharge vessels having the shape of FIG. 2, the data being listed in the table. Data of a commercially available lamp (no. 3) are included in the table for comparison. This is a lamp of the Philips SDW 50 type.

TABLE

| lamp no. | 1 | 2 | 3 |
|---|---|---|---|
| D (mm) | 13 | 11 | 16.6 |
| $d_i$ (mm) | 2.1 | 1.7 | 3.5 |
| $D/d_i$ | 6.2 | 6.5 | 4.7 |
| lamp power (W) | 55 | 55 | 53 |
| wall load (W/cm$^2$) | 64 | 94 | 29 |
| $T_c$ (K) | 2680 | 2800 | 2500 |
| $R_a$ | 82 | 82 | 82 |
| luminous efficacy (lm/W) | 48 | 50 | 47 |
| max. wall temperature (K) | 1350 | 1370 | 1430 |

The discharge vessels were filled with Na/Hg=15/40 (weight ratio) and with Xe having a pressure of 530 mbar at 300K (53 kPa). The lamps no. 1 and 2 had a gas filling consisting of $N_2$ in the space 8 with a pressure of approximately 1 under nominal operating conditions. The space 8 in the known lamp was evacuated.

Under nominal operating conditions, the lamp voltages of the lamps 1, 2 and 3 were 91 V, 93 V, and 90 V, respectively. The difference in lamp voltage of max. 3 V is inside the lamp voltage spread of mass-produced lamps of the Philips SDW 50 type. The discharge vessels had an interior length of 18 mm (lamp 1); 17 mm (lamp 2) and 24 mm (lamp 3). The wall thickness of lamp 1 was 1.4 mm, of lamp 2 1.5 mm. The wall thickness of the known lamp is 0.8 mm.

We claim:

1. An optimized high pressure sodium discharge lamp which emits white light during lamp operation having a color temperature $T_c$ of at least 2400K and a color rendering $R_a$ of greater than 80, said lamp comprising:

a gas filled outer envelope;

a sealed ceramic discharge vessel disposed within said outer envelope, said discharge vessel having having a pair of opposing discharge electrodes with respective tips spaced apart by a distance D and a ceramic wall portion having a substantially constant circular cross-section with an internal diameter $d_i$ over said distance D, a pair of current supply conductors each connected to a respective discharge electrode and extending through said discharge vessel for permitting supply of electric power to said discharge electrodes, the ratio $D/d_i$ having a value greater than 6 and less than or equal to 10, and a quantity of sodium and a rare gas within said discharge vessel; and said discharge vessel having a wall load, defined as the ratio of the nominal lamp power divided by the interior surface area of said discharge vessel over said distance D, of greater than 60 W/cm$^2$ under nominal operating conditions.

2. A high pressure sodium discharge lamp according to claim 1, wherein said ceramic wall portion has a constant wall thickness over said distance D, said wall thickness and said gas fill in said outer envelope being optimized such that the wall temperature of said discharge vessel does not exceed about 1400K during nominal lamp operation.

3. A high pressure discharge lamp according to claim 2, wherein said wall thickness of said wall portion is less than 3 mm.

4. A high pressure discharge lamp according to claim 3, wherein said lamp has a luminous efficacy of greater than about 48 lumens/Watt.

5. A high pressure discharge lamp according to claim 4, wherein said lamp has a color temperature of greater than or equal to about 2680K and a color rendering $R_a$ of greater than or equal to 82.

6. A high pressure discharge lamp according to claim 3, wherein said lamp has a color temperature of greater than or equal to about 2680K and a color rendering $R_a$ of greater than or equal to 82.

7. A high pressure discharge lamp according to claim 1, wherein said lamp has a luminous efficacy of greater than about 48 lumens/Watt.

8. A high pressure discharge lamp according to claim 7, wherein said lamp has a color temperature of greater than or equal to about 2680K and a color rendering $R_a$ of greater than or equal to 82.

9. A high pressure discharge lamp according to claim 1, wherein said lamp has a color temperature of greater than or equal to about 2680K and a color rendering $R_a$ of greater than or equal to 82.

10. A high pressure discharge lamp according to claim 1, wherein the distance D between said electrode tips is from about 11 mm to about 13 mm.

* * * * *

UNITED STATES PATENT AND TRADEMARK OFFICE

CERTIFICATE OF CORRECTION

PATENT NO. : 5,153,482

DATED : October 6, 1992

INVENTOR(S) : Robertus A.J. Keijser, et al

It is certified that error appears in the above-indentified patent and that said Letters Patent is hereby corrected as shown below:

Col. 4

| | | |
|---|---|---|
| Claim 1, | line 4, | after "lamp" insert --,-- (comma); |
| | line 5, | delete "which emits white light during lamp operation having a"; |
| | line 6, | delete "color temperature $T_c$ of at least 2400K and a color ren-"; |
| | line 7, | delete "dering $R_a$ of greater than 80, said lamp"; |
| | line 10, | delete "hav"; |
| | line 11, | delete "ing"; |
| | line 21, | delete "and a quantity of sodium and a rare gas"; |
| | line 22, | change "within said discharge vessel, and" to --said discharge vessel being free of fin means attached thereto for cooling said discharge vessel--; |

UNITED STATES PATENT AND TRADEMARK OFFICE

CERTIFICATE OF CORRECTION

PATENT NO. : 5,153,482

DATED : October 6, 1992

INVENTOR(S) : Robertus A.J. Keijser, et al

It is certified that error appears in the above-indentified patent and that said Letters Patent is hereby corrected as shown below:

Col. 4, Claim 1, line 27, after "conditions" insert --; and a discharge sustaining filling within said discharge vessel comprising sodium and a rare gas selected such that said discharge vessel emits white light during lamp operation having a color temperature greater than 2500°K and a color rendering index Ra of greater than 80.--.

Signed and Sealed this

Twenty-eighth Day of September, 1993

Bruce Lehman

*Attest:*

BRUCE LEHMAN

*Attesting Officer*

*Commissioner of Patents and Trademarks*